United States Patent [19]

Verduci

[11] Patent Number: 5,056,506

[45] Date of Patent: Oct. 15, 1991

[54] VERSATILE RELAXING CHAIR

[76] Inventor: A Verduci, 6476 Thornberry, Windsor, Ontario, Canada, N8T 2X1

[21] Appl. No.: 574,077

[22] Filed: Aug. 29, 1990

[51] Int. Cl.[5] ..... A61H 1/00

[52] U.S. Cl. ..... 128/32; 128/33; 128/64; 128/36; 128/36; 128/41

[58] Field of Search ..... 128/32, 33, 45, 46, 128/57, 58, 35, 36, 64, 41; 297/16, 18, 19, 20, 21, 22, 23, 25, 26, 29

[56] References Cited

U.S. PATENT DOCUMENTS

| | | | |
|---|---|---|---|
| 2,697,476 | 12/1954 | Tripodi et al. | 297/19 |
| 3,138,400 | 6/1964 | Reid . | |
| 3,358,679 | 12/1967 | Borrelli | 128/33 |
| 4,118,064 | 10/1978 | Robeson | 297/19 X |
| 4,202,326 | 5/1980 | Van Gerpen | 128/33 |
| 4,614,378 | 9/1986 | Picou | 297/19 X |
| 4,967,871 | 11/1990 | Komatsubara | 128/33 X |

*Primary Examiner*—Mickey Yu
*Assistant Examiner*—Brian E. Hanlon
*Attorney, Agent, or Firm*—Michael I. Kroll

[57] ABSTRACT

A versatile relaxing chair is provided and consists of two elongated U-shaped frame members oppositely intermingled with each other and held together in a stationary manner. A plurality of nylon cable strips with stationary plastic spheres extend across the long sides of the elongated U-shaped frame members so that a person can sit in the chair. A mechanism causes vibrations through the chair so that the person in the chair can get a massage.

4 Claims, 1 Drawing Sheet

VERSATILE RELAXING CHAIR

BACKGROUND OF THE INVENTION

1. Field of the Invention

The instant invention relates generally to chaise lounges and more specifically it relates to a versatile relaxing chair.

2. Description of the Prior Art

Numerous chaise lounges have been provided in prior art that are adapted to be reclining chairs with seats long enough to support the outstretched legs of the sitters. While these units may be suitable for the particular purpose to which they address, they would not be as suitable for the purposes of the present invention as heretofore described.

SUMMARY OF THE INVENTION

A primary object of the present invention is to provide a versatile relaxing chair that will overcome the shortcomings of the prior art devices.

Another object is to provide a versatile relaxing chair in which an adjustable intensity and frequency vibration massage is given to a person sitting in the chair.

An additional object is to provide a versatile relaxing chair that can be adjustable in position and in size to the requirements of the person who will sit in the chair.

A further object is to provide a versatile relaxing chair that is simple and easy to use.

A still further object is to provide a versatile relaxing chair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
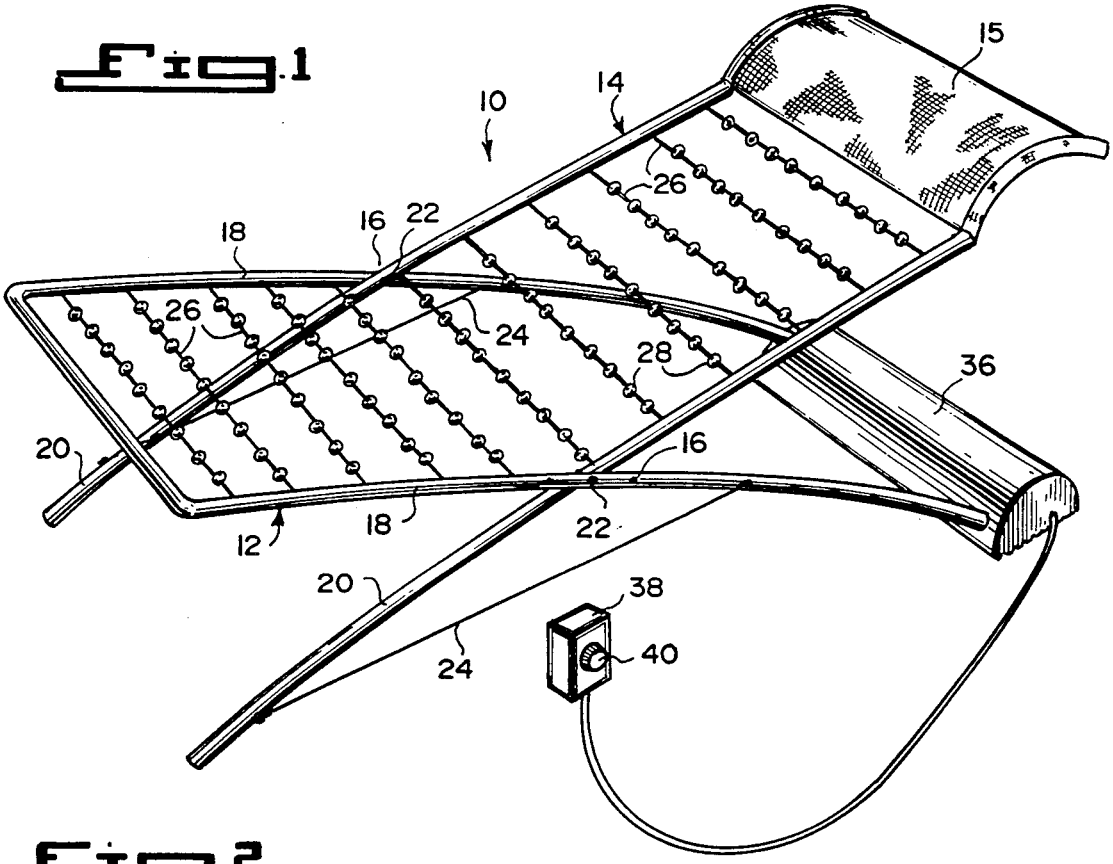
FIG. 1 is a perspective view of the instant invention.
Figure 2:
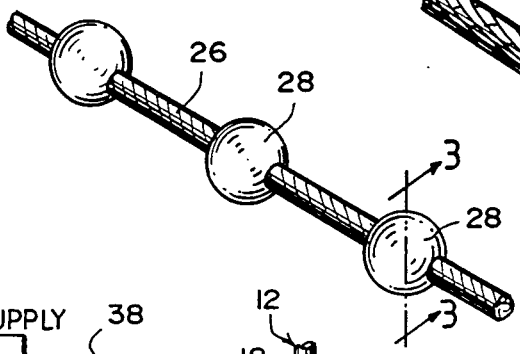
FIG. 2 is a perspective view of a portion of one of the nylon cable strips with stationary plastic spheres thereon.
Figure 3:
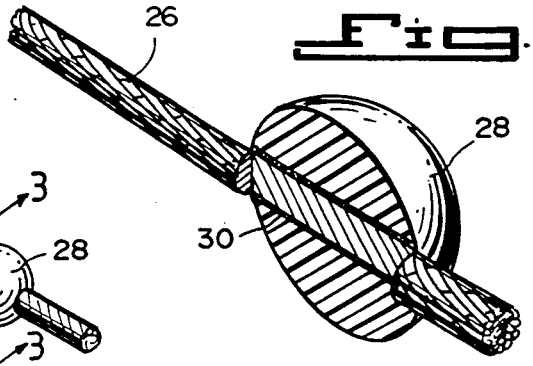
FIG. 3 is a perspective cross sectional view taken along line 3—3 in FIG. 2 showing the adhesive for securing the sphere to the nylon cable strip.
Figure 4:
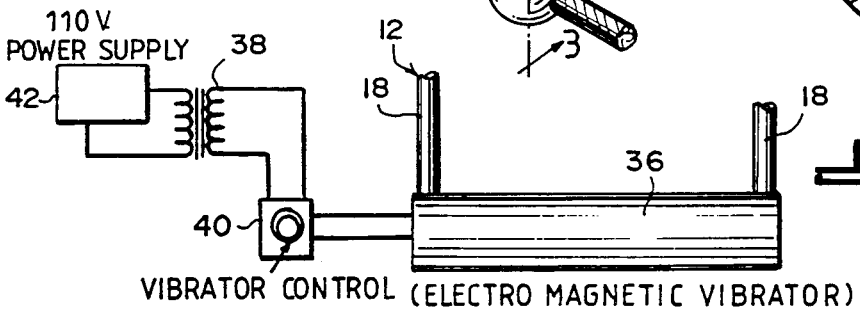
FIG. 4 is a schematic diagram of the electrical circuit of the vibration system.

Turning now descriptively to the drawings, in which similar reference characters denote similar elements throughout the several views, the Figures illustrates a versatile relaxing chair 10 consisting of a first elongated U-shaped frame member 12. A second elongated U-shaped frame member 14 has a headrest 15 and is oppositely intermingled with the first elongated U-shaped frame member 12 at two axle aperture points 16 along the long sides 18 and 20 thereof. A pair of axle pins 22 are provided with each inserted in one of the two axle aperture points 16 to hold the first elongated U-shaped frame member 12 to the second elongated U-shaped frame member 14. One of a pair of retainer members 24, each extend between one of the long sides 18 and 20 of the first elongated U-shaped frame member 12 and the second elongated U-shaped frame member 14 so that the distal ends of the long sides 18 and 20 can sit securely upon a flat surface.

Nylon cable strips 26 are spaced apart and extend across the long sides 18 and 20 of the first elongated U-shaped frame member 12 and the second elongated U-shaped frame member 14. Plastic spheres 28 are spaced apart and affixed in a stationary position with adhesive 30 onto the nylon cable strips 26 so that a person can sit in the chair 10. A mechanism 32 is on the distal ends of the long sides 18 of the first elongated U-shaped frame member 12 for causing vibrations through the chair 10 so as to massage the person sitting in the chair 10.

The first U-shaped frame member 12 has a plurality of spaced apart axle aperture points 16 on each long side 18 thereof so that each axle pin 22 can be inserted in each matching axle aperture point 16 so that the chair 10 can be adjusted in various lengths for different sized people. The first U-shaped frame member 12 also has a plurality of spaced apart small holes 34 on each long side 18 thereof so that each retainer member 24 fan engage with each matching small hole 34 and the chair 10 can be adjusted in various positions to allow the person sitting in the chair 10 to go from a sitting to a lying position.

The vibrating mechanism 32 includes an electro-magnetic vibrator 36 connected to the distal ends of the long sides 18 of the first elongated U-shaped frame member 12. A transformer 38 having a variable control 40 is electrically connected between a one hundred and ten volt power supply 42 and the electro-magnetic vibrator 36 so that the person sitting in the chair 10 can change the intensity and frequency of the vibrations from the electro-magnetic vibrator 36.

LIST OF REFERENCE NUMBERS

10 versatile relaxing chair
12 first elongated U-shaped frame member
14 second elongated U-shaped frame member
15 headrest on 14
16 axle aperture point
18 long side of 12
20 long side of 14
22 axle pin
24 retainer member
26 nylon cable strip
28 plastic sphere
30 adhesive
32 vibrating mechanism
34 small hole in 18
36 electro-magnetic vibrator
38 transformer
40 variable control for 38
42 one hundred and ten volt power supply It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A versatile relaxing chair, comprising:

(a) a first elongated U-shaped open ended frame member;

(b) a second elongated U-shaped open ended frame member having a head rest and oppositely intermingled with said first elongated U-shaped open ended frame member directly with two axle aperture points along the long sides thereof, said first and said second elongated U-shaped open ended frame members are substantially the same size;

(c) a pair of axle pins, each inserted in one of the two axle aperture points to hold said first elongated U-shaped open ended frame member to said second elongated U-shaped open ended frame member;

(d) a pair of retainer members, each extending between one of the long sides of said first elongated U-shaped open ended frame member and said second elongated U-shaped open ended frame member so that the distal ends of the long sides can sit securely upon a flat surface in a number of different positions, such as a lounge chair and a bed;

(e) a plurality of nylon cable strips, spaced apart and extending across the long sides of said first elongated U-shaped open ended frame member and said second elongated U-shaped open ended frame member;

(f) a plurality of plastic spheres spaced apart from each other and affixed in a stationary position onto said nylon cable strips longitudinally and laterally so that a person can sit in said chair; and (g) means, on the distal ends of the long sides of said first elongated U-shaped open ended frame member, for causing vibrations through said chair so as to massage the person sitting in said chair.

2. A versatile relaxing chair as recited in claim 1, wherein said first U-shaped frame member has a plurality of spaced apart axle aperture points on each long side thereof so that each said axle pin can be inserted in each matching axle aperture point so that said chair can be adjusted in various lengths for different sized people.

3. A versatile relaxing chair as recited in claim 1, wherein said first U-shaped frame member has a plurality of spaced apart small holes on each long side thereof so that each said retainer member can engage with each matching small hole and said chair can be adjusted in various positions to allow the person sitting in said chair to go from a sitting to a lying position.

4. A versatile relaxing chair as recited in claim 3, wherein said vibration causing means includes:

(a) an electro-magnetic vibrator connected to the distal ends of the long sides of said first elongated U-shaped frame member;

(b) a transformer having a variable control electrically connected between a one hundred and ten volt power supply and said electro-magnetic vibrator so that the person sitting in said chair can change the intensity and frequency of the vibrations from said electro-magnetic vibrator.

* * * * *